US006575453B2

(12) United States Patent
Chiang

(10) Patent No.: US 6,575,453 B2
(45) Date of Patent: Jun. 10, 2003

(54) PRESSURE-ADJUSTABLE MECHANISM FOR PAPER FEEDING ROLLER OF AUTOMATIC PAPER FEEDER

(75) Inventor: Shu-Ya Chiang, Taichung (TW)

(73) Assignee: Umax Data Systems Inc., Hsinchu (TW)

( * ) Notice: Subject to any disclaimer, the term of this patent is extended or adjusted under 35 U.S.C. 154(b) by 0 days.

(21) Appl. No.: 09/985,713

(22) Filed: Nov. 6, 2001

(65) Prior Publication Data

US 2003/0085509 A1 May 8, 2003

(51) Int. Cl.[7] ..... B65H 3/52

(52) U.S. Cl. ..... 271/124; 271/125; 271/126; 271/127; 271/160; 271/167

(58) Field of Search ..... 271/110, 147, 271/162, 163, 117, 126, 127, 124, 125, 160

(56) References Cited

U.S. PATENT DOCUMENTS

| | | | | | |
|---|---|---|---|---|---|
| 4,212,456 | A | * | 7/1980 | Ruenzi | 271/4.04 |
| 5,377,970 | A | * | 1/1995 | Kikuchi | 271/121 |
| 5,391,009 | A | * | 2/1995 | Stodder | 400/605 |
| 6,126,161 | A | * | 10/2000 | Kato | 271/121 |
| 6,331,002 | B1 | * | 12/2001 | Yoshino et al. | 271/117 |

* cited by examiner

*Primary Examiner*—Donald P. Walsh
*Assistant Examiner*—Kaitlin Joerger
(74) *Attorney, Agent, or Firm*—Rosenberg, Klein & Lee

(57) ABSTRACT

An automatic paper feeder for an image-scanning device with a pressure-adjustable mechanism for adjusting the paper feeding roller of the automatic paper feeder is disclosed. A pressure from paper sheets stacked on a paper tray of the automatic paper feeder is detected by a paper tray pressure detecting mechanism and transferred to a roller pressure adjusting mechanism to change a pressure between the paper feeding roller and a paper separating plate and adjust a feeding angle of the movable paper tray.

8 Claims, 6 Drawing Sheets

PRESSURE-ADJUSTABLE MECHANISM FOR PAPER FEEDING ROLLER OF AUTOMATIC PAPER FEEDER

BACKGROUND OF THE INVENTION

1. Field of the Invention

The present invention relates to an automatic paper feeder for an image-scanning device, and more particularly to a pressure-adjustable mechanism for the paper feeding roller of the automatic paper feeder.

2. Description of the Prior Art

An automatic paper feeder is frequently included in various kinds of office automation equipment, such as image-scanning device, photocopier, printer, etc., so that paper sheets to be scanned, copied or printed could be automatically separated and fed via the automatic paper feeder. FIG. 1 illustrates a scanner 1 and a conventional automatic paper feeder 2 associated therewith. The scanner 1 is internally provided with an optical scanning module 11, a pair of guide bars 12, and related optical components, such as focusing lens, image sensor, driving mechanism, etc. The optical scanning module 11 is moved along the guide bars 12 under control of a control circuit of the scanner 1, and a sheet of paper 3 to be scanned is fed with the automatic paper feeder 2 for image scanning.

FIG. 2 shows an internal structure of the automatic paper feeder 2 of FIG. 1. The automatic paper feeder 2 mainly includes a paper tray 21, a paper feeding roller 22, a paper pressing plate 23, a stopping plate 24, a paper separating mechanism 25, and a paper separating plate 26. Paper sheets 3 to be fed are stacked on the paper tray 21 and held in place under a pressure applied by the paper pressing plate 23 on the paper sheets 3. Meanwhile, lower ends of the stacked paper sheets 3 are positioned against the stopping plate 24. A main function of the paper separating mechanism 25 is to provide a proper gap between the stopping plate 24 and the paper feeding roller 22 and to apply a proper pressure against the paper separating plate 26.

When the paper feeding roller 22 rotates, it brings a lowermost sheet of paper 3 in the paper tray 21 to move in a direction indicated by arrow I toward the gap between the paper feeding roller 22 and the paper separating plate 26. In the event two or more sheets of paper 3 are fed toward the gap, a difference between the friction coefficients of the paper-feeding roller 22 and the paper separating plate 26 would allow only the paper in contact with the paper feeding roller 22 to move through the gap. Therefore, the stacked paper sheets 3 could be separately fed for scanning one by one.

Conventionally, the paper tray 21 is a fixed-type structure. That is, the paper tray 21 is always fixedly mounted in the automatic paper feeder 2 independent of the quantity of paper sheet 3 on the paper tray 21. Meanwhile, the gap between the paper feeding roller 22 and the paper separating plate 26 is always constant, too. It is found, however, in actual operation of the conventional automatic paper feeder 2 having fixed paper tray 21, increased weight or amount of paper sheets 3 on the paper tray 21 would often have influences on accurate paper dispensing of the automatic paper feeder 2. Problems such as difficult paper feeding and paper dispensing occur when the weight or the amount of paper sheets 3 on the paper tray 21 increases.

SUMMARY OF THE INVENTION

It is therefore a primary object of the present invention to provide a pressure-adjustable mechanism for paper feeding roller in an automatic paper feeder, so that a pressure from the paper feeding roller is automatically adjusted when there is an increased amount of paper sheets stacked on the paper tray of the automatic paper feeder, and that an accurate paper dispensing is maintained.

Another object of the present invention is to provide a movable pressure-adjustable mechanism for paper feeding roller in an automatic paper feeder, wherein the pressure-adjustable mechanism could be actuated by an overall weight or number of paper sheets stacked on a movable paper tray to automatically adjust a pressure from the paper feeding roller for dispensing the paper sheets.

A further object of the present invention is to provide a self-adjustable pressure-adjustable mechanism for paper feeding roller in an automatic paper feeder, wherein a movable paper tray is pivotally lowered due to a weight of paper sheets stacked thereon and thereby lifts the paper feeding roller by a proper distance and adjusts a paper feeding angle of the paper tray as well as a frictional pressure between the paper feeding roller and a paper separating plate, so that good paper dispensing effect could be maintained.

To achieve the above and other objects, the structure according to the present invention mainly includes a pressure-adjustable mechanism for adjusting the paper feeding roller of the automatic paper feeder with respect to the paper separating mechanism of the automatic paper feeder. A pressure from paper sheets stacked on a paper tray of the automatic paper feeder is detected by a paper tray pressure detecting mechanism and transferred to a roller pressure adjusting mechanism to change a pressure between the paper feeding roller and a paper separating plate and adjust a feeding angle of the movable paper tray.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
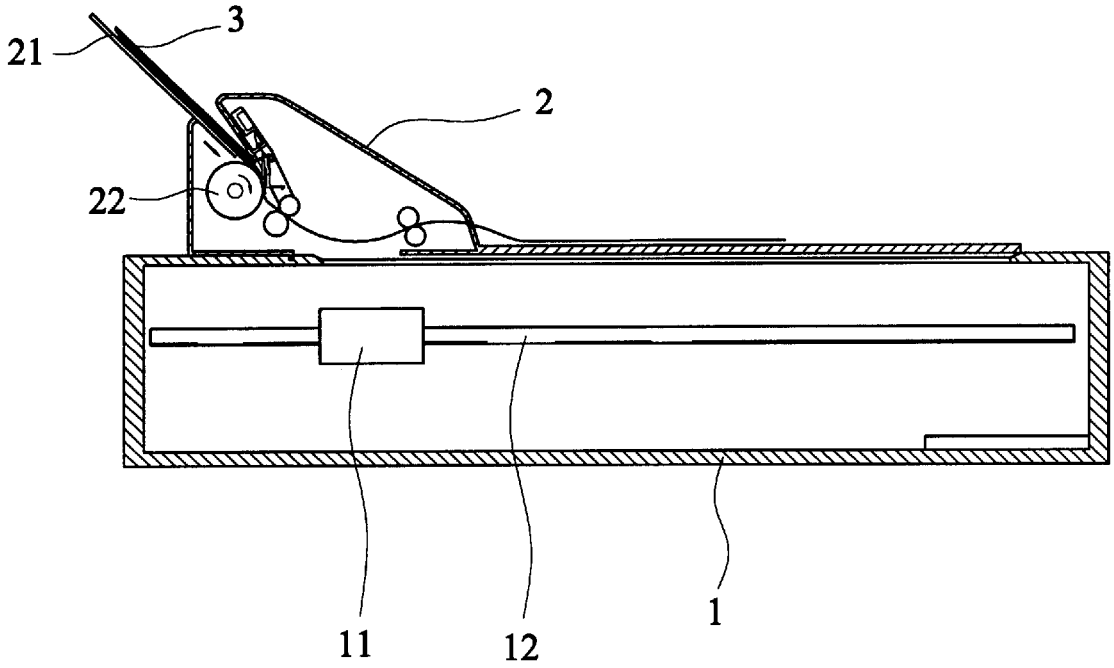
FIG.1(Prior Art)
FIG. 1 is a sectioned side view of a scanner and a conventional automatic paper feeder associated with the scanner.
Figure 2:
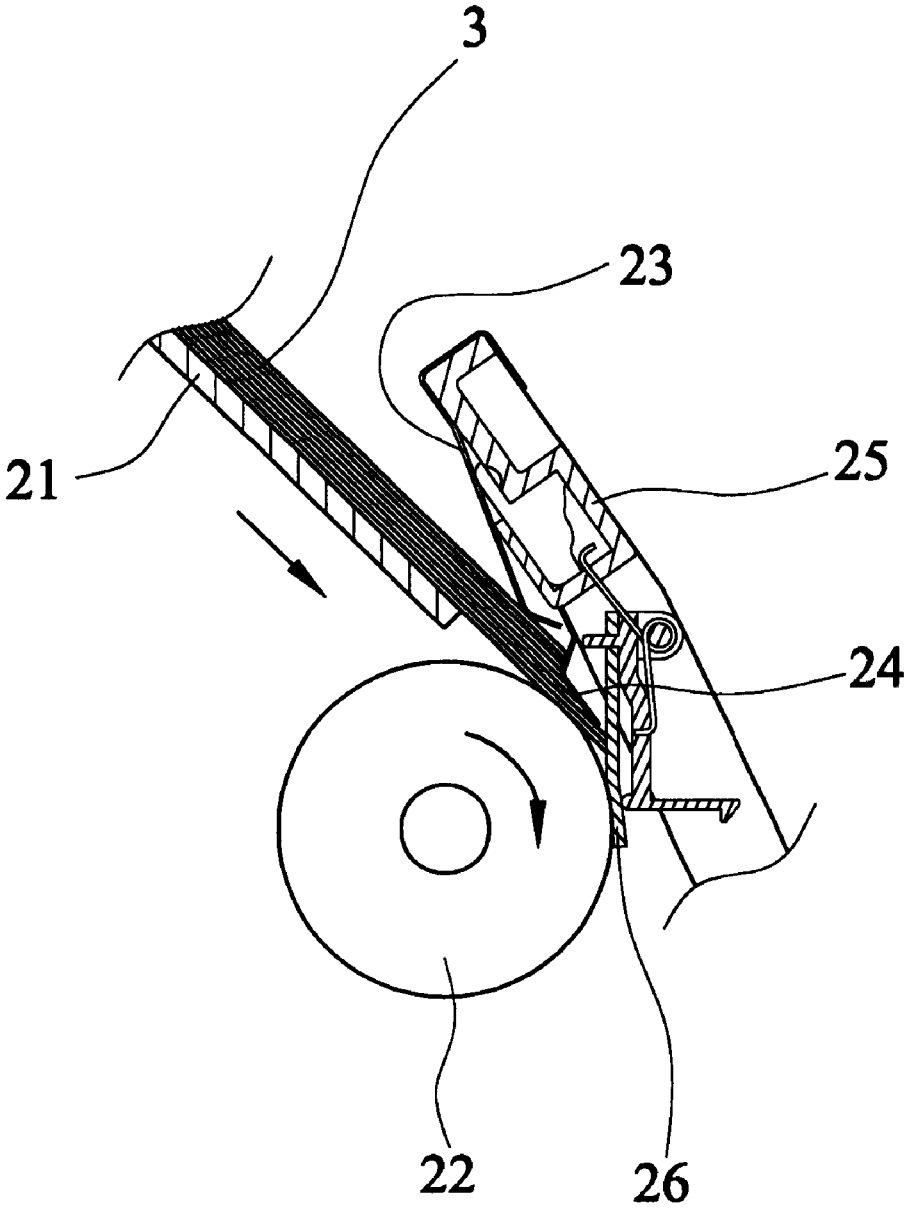
FIG.2(Prior Art)
FIG. 2 is an enlarged and sectioned side view of the automatic paper feeder of FIG. 1, in which a fixed-type paper tray is provided.
Figure 3:
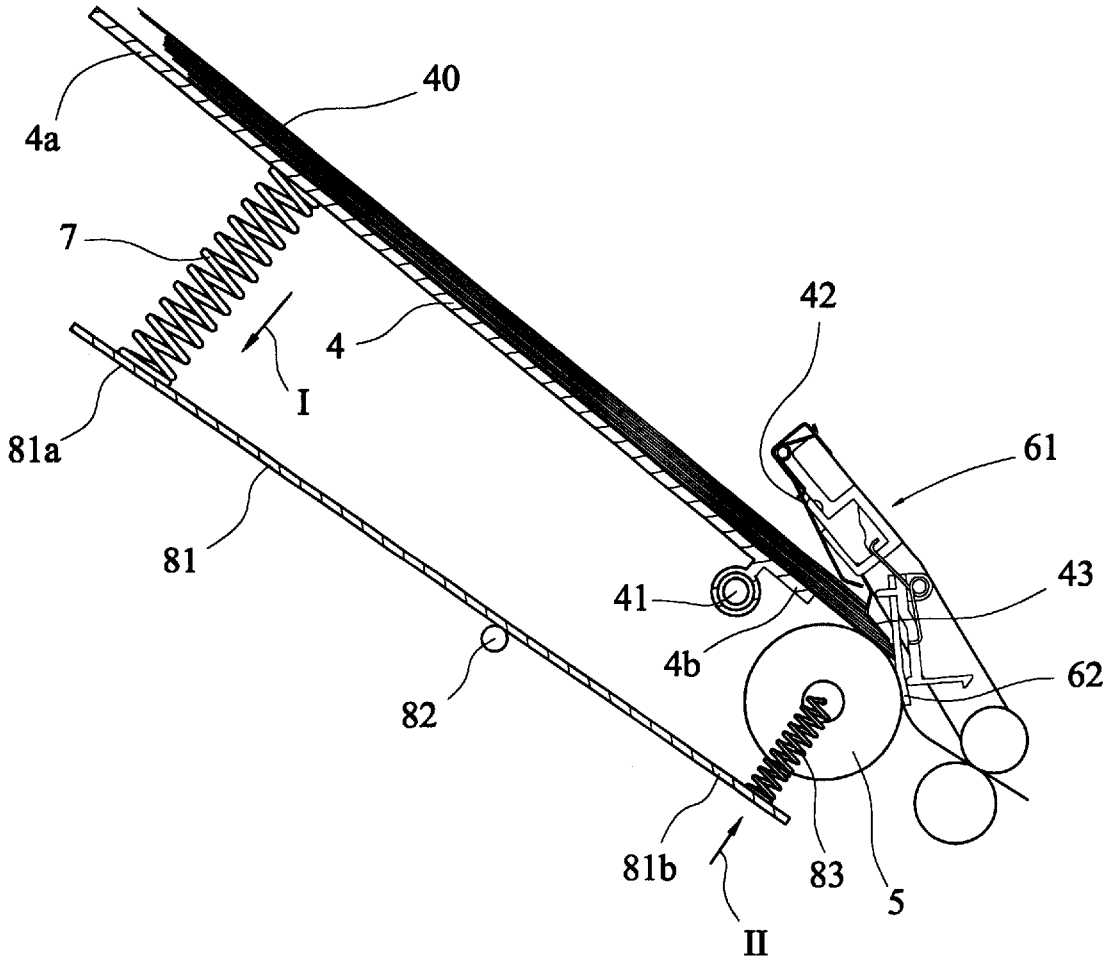
FIG. 3 is a sectioned side view of a pressure-adjustable mechanism for paper feeding roller in an automatic paper feeder according to a first embodiment of the present invention.

Please refer to FIG. 3 that is a sectioned side view of a pressure-adjustable mechanism for paper feeding roller in an automatic paper feeder according to a first embodiment of the present invention. In this embodiment, the pressure-adjustable mechanism mainly includes a movable paper tray 4 on which a plurality of paper sheets 40 may be stacked. The movable paper tray 4 is rotatably supported on a supporting shaft 41 mounted to a fixed position in the automatic paper feeder, so that a length of the movable paper tray 4 to the left side of the supporting shaft 41, as viewed in front of FIG. 3, forms a paper supporting end 4*a*, and an end of the paper tray 4 opposite to the end 4*a* forms a paper-out end 4*b*.

A paper feeding roller 5 is located downstream closely below the paper-out end 4*b* of the movable paper tray 4, and a paper separating mechanism 61 and a paper separating plate 62 are located downstream closely above the paper-out end 4*b* of the movable paper tray 4, so that a proper gap is provided between the paper separating plate 62 and the paper feeding roller 5 for a sheet of paper 40 to pass therethrough.

In the present invention, there is a paper tray pressure detecting mechanism located below the movable paper tray 4 for detecting an overall weight of paper sheets 40 stacked on the movable paper tray 4. In the first embodiment of the present invention, the paper tray pressure detecting mechanism includes a spring element 7 having an upper end pressed against a bottom surface of the paper supporting end 4*a* of the movable paper tray 4.

A roller pressure adjusting mechanism is also located below the movable paper tray 4 for adjusting a pressure between the paper feeding roller 5 and the paper separating plate 62. The roller pressure adjusting mechanism includes a pressure transfer member 81 having a first end 81*a*, against which a lower end of the spring element 7 is pressed. A pressure sensed by the spring element 7 of the paper tray pressure detecting mechanism is transferred in a first direction as indicated by the arrow I to the first end 81*a* of the pressure transfer member 81.

A supporting shaft 82 is located at a lower side of the pressure transfer member 81 to serve as a fulcrum for the pressure transfer member 81 to function like a lever. A second end 81*b* of the pressure transfer member 81 is in the vicinity of the paper feeding roller 5 and has a paper feeding roller displacement element 83 provided thereat. With these arrangements, the pressure of the paper tray 4 transferred in the first direction I to the pressure transfer member 81 is further transferred in a second direction II from the second end 81*b* of the pressure transfer member 81 to the paper feeding roller 5 via the paper feeding roller displacement element 83, so that the paper feeding roller 5 is displaced by a certain degree to adjust a pressure between the paper feeding roller 5 and the paper separating plate 62.

In the pressure-adjustable mechanism of the present invention, there is provided with a paper pressing mechanism 42 located over a top of the movable paper tray 4 to apply a proper pressure on the paper sheets 40 stacked on the movable paper tray 4, and a stopping plate 43 located above the paper-out end 4*b* of the movable paper tray 4 and between the paper pressing mechanism 42 and the paper separating plate 62 to provide a first-stage stopping of the paper sheets 40 on the movable paper tray 4, so that only one or a few lowermost sheets are admitted into the gap between the paper feeding roller 5 and the paper separating plate 62.

With the above arrangements, a pressure from the weight of paper sheets 40 stacked on the movable paper tray 4 is detected by the spring element 7 and transferred to the pressure transfer member 81 and the paper feeding roller displacement element 83, so as to change the pressure between the paper feeding roller 5 and the paper separating plate 62 and to adjust the paper feeding angle of the paper tray 4 enabling the paper feeding roller 5 and the paper separating plate 62 to maintain a proper frictional pressure difference between them and accordingly keep good paper separating function of the automatic paper feeder.

Figure 4:
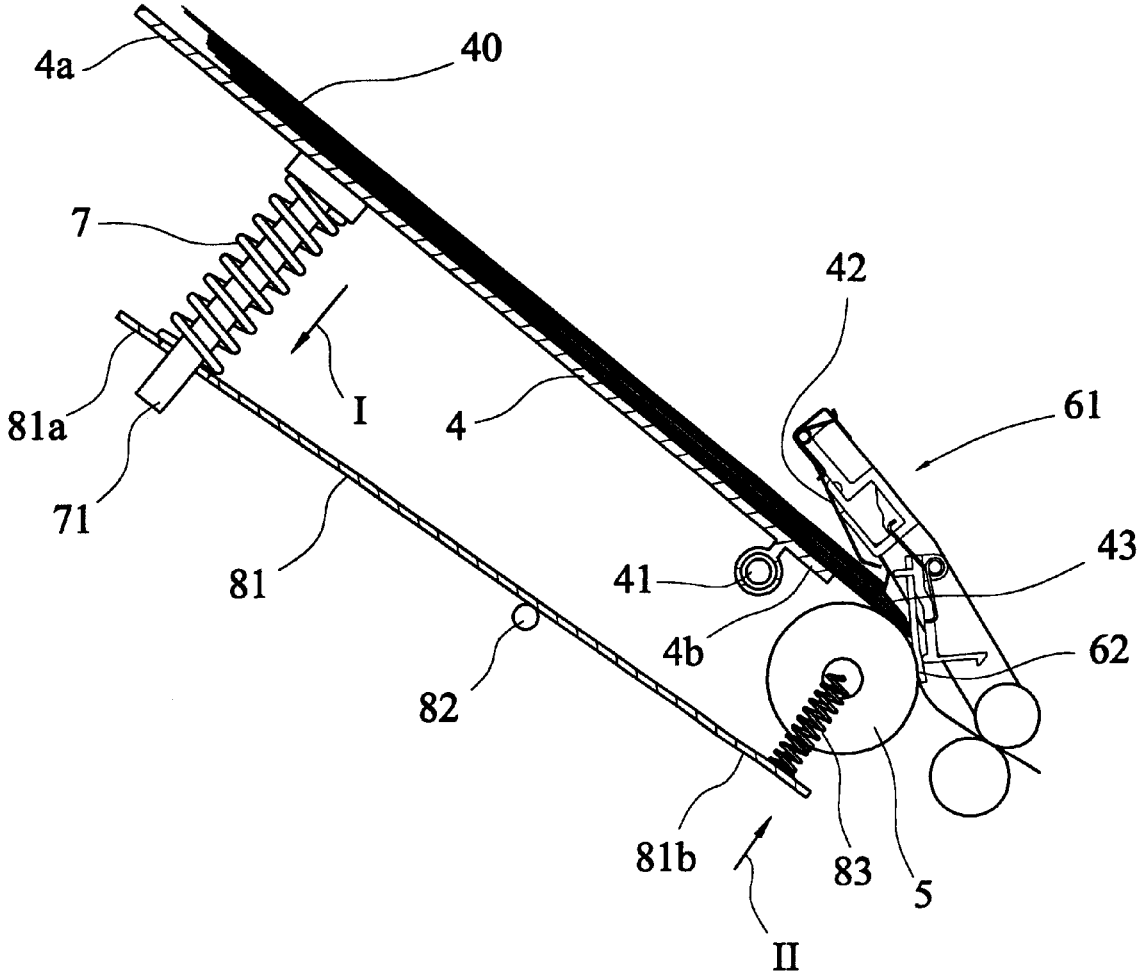
FIG. 4 is a sectioned side view of a pressure-adjustable mechanism for paper feeding roller in an automatic paper feeder according to a second embodiment of the present invention.

FIG. 4 is a sectioned side view of a pressure-adjustable mechanism for paper feeding roller in an automatic paper feeder according to a second embodiment of the present invention. The second embodiment of the present invention has a structure generally similar to that of the first embodiment shown in FIG. 3, except that the paper tray pressure detecting mechanism further includes a guiding post 71 provided at the bottom side of the movable paper tray 4 to extend toward the pressure transfer member 81 by a proper distance. The spring element 7 is put around the guiding post 71 to avoid undesired deviation of the spring element 7 when the same is compressed or extended due to changes in the weight of paper sheets 40 on the movable paper tray 4.

Figure 5:
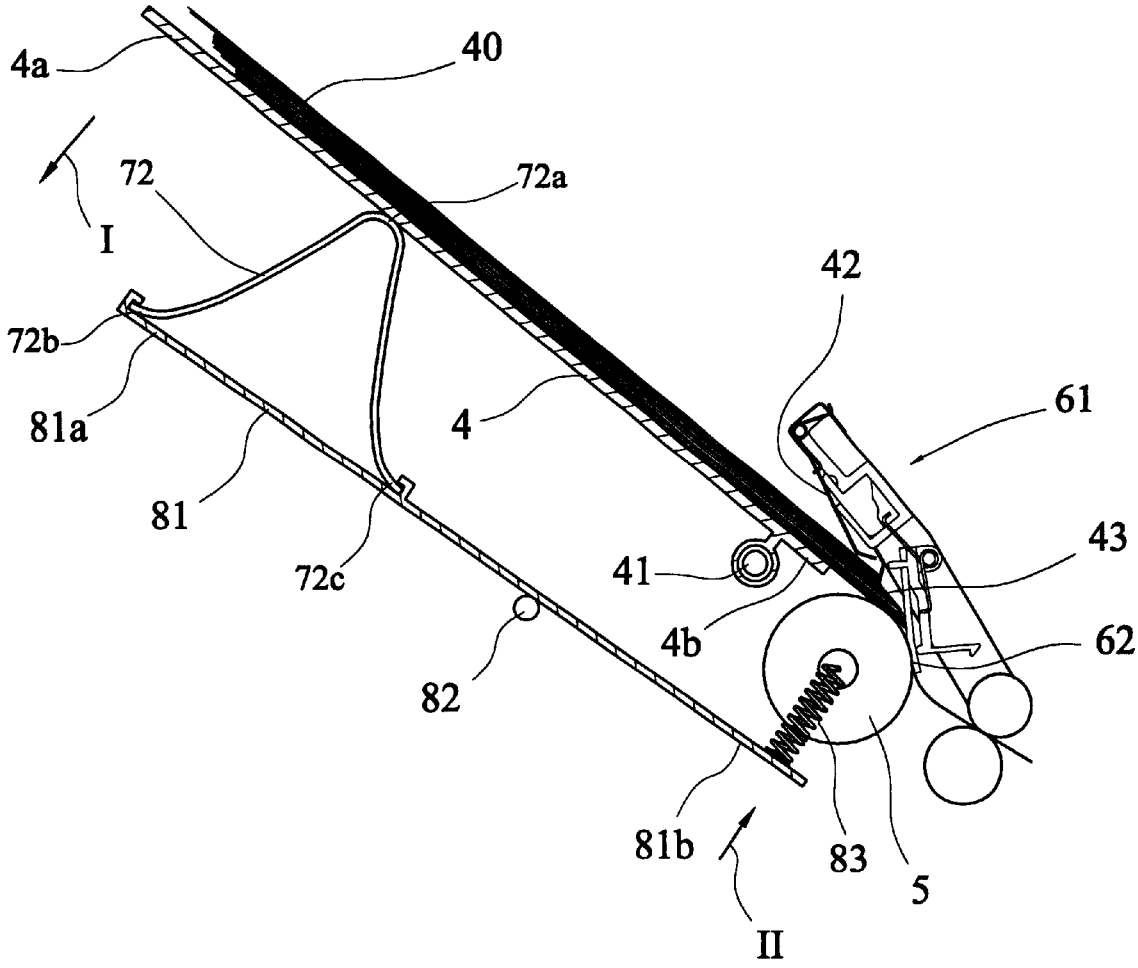
FIG. 5 is a sectioned side view of a pressure-adjustable mechanism for paper feeding roller in an automatic paper feeder according to a third embodiment of the present invention.

FIG. 5 is a sectioned side view of a pressure-adjustable mechanism for paper feeding roller in an automatic paper feeder according to a third embodiment of the present invention. The third embodiment of the present invention also has a structure generally similar to that of the first embodiment shown in FIG. 3, except that the paper tray pressure detecting mechanism includes an arched leaf spring 72 to replace the spring element 7. An apex 72*a* of the arched leaf spring 72 is pressed against the bottom side of the movable paper tray 4, and two free ends 72*b*, 72*c* of the arched leaf spring 72 are pressed against the pressure transfer member 81. The arched leaf spring 72 functions equally well as the spring element 7 to transfer the pressure of paper on the movable paper tray 4 to the pressure transfer member 81.

Figure 6:
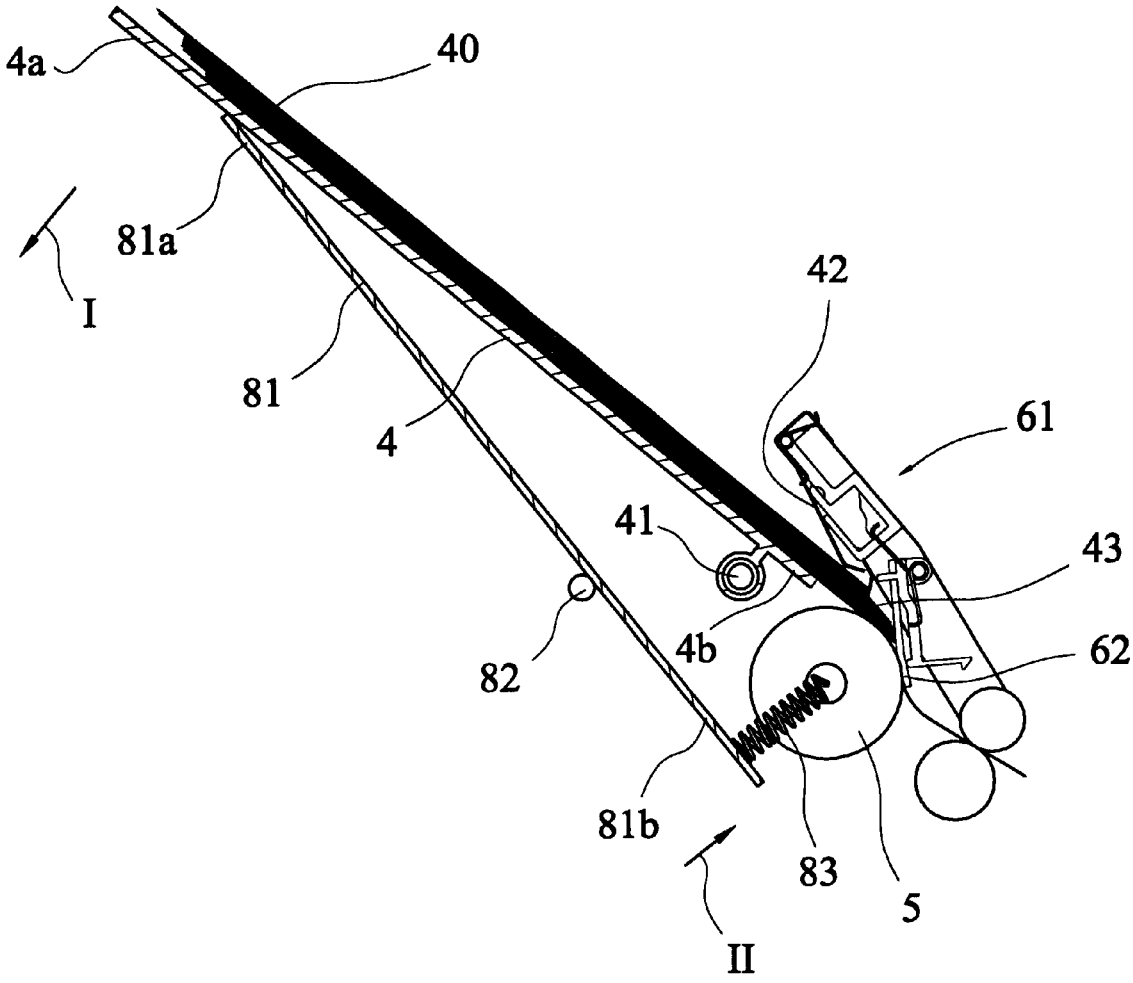
FIG. 6 is a sectioned side view of a pressure-adjustable mechanism for paper feeding roller in an automatic paper feeder according to a fourth embodiment of the present invention.

FIG. 6 is a sectioned side view of a pressure-adjustable mechanism for paper feeding roller in an automatic paper feeder according to a fourth embodiment of the present invention. The fourth embodiment of the present invention also has a structure generally similar to that of the first embodiment shown in FIG. 3, except that the paper tray pressure detecting mechanism does not include any spring element and the first end 81*a* of the pressure transfer member 81 is directly abutted on the bottom side of the movable paper tray 4. In this manner of arrangement, the weight of paper on the movable paper tray 4 could similarly be transferred to the paper feeding roller 5 via the pressure transfer member 81 and the paper feeding roller displacement element 83, causing the paper feeding roller 5 to displace by an amount and therefore adjust the pressure between the paper feeding roller 5 and the paper separating plate 62.

It is apparent that although the present invention is illustrated with the description of a preferred embodiments of the system in accordance with the present invention, it is contemplated that there may be changes and modifications in the described embodiment and examples that can be carried out without departing from the scope of the invention which is intended to be limited only by the appended claims

What is claimed is:

1. A pressure-adjustable mechanism for a paper feeding roller in an automatic paper feeder, comprising:

a movable paper tray being rotatably supported on said automatic paper feeder, said movable paper tray having a paper-out end and a paper supporting end on which a plurality of paper sheets are stacked;

a paper feeding roller located downstream closely below said paper-out end of said movable paper tray;

a paper separating plate located downstream closely above said paper-out end of said movable paper tray;

a paper tray pressure detecting mechanism for detecting a pressure applied thereon by a weight of said paper sheets stacked on said movable paper tray; and a roller pressure adjusting mechanism for adjusting a pressure between said paper feeding roller and said paper separating plate;

whereby said pressure from the weight of said paper stacked on said movable paper tray detected by said paper tray pressure detecting mechanism is transferred to said roller pressure adjusting mechanism for the same to change said pressure between said paper feeding roller and said paper separating plate and to adjust a paper feeding angle of said movable paper tray, enabling smooth sending of a lowermost sheet of said paper sheets on said movable paper tray out of said paper-out end.

2. The pressure-adjustable mechanism as claimed in claim 1, wherein said roller pressure adjusting mechanism comprises:

a pressure transfer member for transferring said pressure detected by said paper tray pressure detecting mechanism, and having a fulcrum, a first end, and a second end;

a supporting shaft pressed against said fulcrum of said pressure transfer member for the latter to work like a lever; and a paper feeding roller displacement element being located at said second end of said pressure transfer member corresponding to said paper feeding roller, and receiving said pressure transferred by said pressure transfer member to displace said paper feeding roller by an amount, so as to adjust said pressure between said paper feeding roller and said paper separating plate.

3. The pressure-adjustable mechanism as claimed in claim 2, wherein said paper tray pressure detecting mechanism is a spring element having an end pressed against a bottom side of said movable paper tray and another end pressed against said first end of said pressure transfer member, allowing said pressure from said paper sheets stacked on said movable paper tray to transfer to said pressure transfer member via said spring element.

4. The pressure-adjustable mechanism as claimed in claim 2, wherein said paper tray pressure detecting mechanism is an arched leaf spring having an apex pressed against a bottom side of said movable paper tray and two free ends pressed against said first end of said pressure transfer member, allowing said pressure from said paper sheets stacked on said movable paper tray to transfer to said pressure transfer member via said arched leaf spring.

5. The pressure-adjustable mechanism as claimed in claim 2, wherein said paper tray pressure detecting mechanism comprises:

a guiding post being provided at a bottom side of said movable paper tray to extend toward said pressure transfer member by a predetermined distance; and a spring element put around said guiding post;

said spring element having an end pressed against said bottom side of said movable paper tray and another end pressed against said first end of said pressure transfer member, allowing said pressure from said paper sheets stacked on said movable paper tray to transfer to said pressure transfer member via said spring element.

6. The pressure-adjustable mechanism as claimed in claim 2, wherein said first end of said pressure transfer member is directly pressed against a bottom side of said movable paper tray to transfer said pressure detected by said paper tray pressure detecting mechanism.

7. The pressure-adjustable mechanism as claimed in claim 1, further comprising a paper pressing mechanism located over a top of said movable paper tray to apply a proper pressure on said paper sheets stacked on said movable paper tray.

8. The pressure-adjustable mechanism as claimed in claim 1, further comprising a stopping plate located above said paper-out end of said movable paper tray and between said paper pressing mechanism and said paper separating plate to stop said paper sheets stacked on said movable paper tray, so that only one or a few lowermost sheets of said stacked paper sheets are admitted into a gap between said paper feeding roller and said paper separating plate.

* * * * *